United States Patent [19]

Purfurst

[11] Patent Number: 4,745,802

[45] Date of Patent: May 24, 1988

[54] FORMATION TESTING TOOL AND METHOD OF OBTAINING POST-TEST DRAWDOWN AND PRESSURE READINGS

[75] Inventor: Ernest H. Purfurst, Houston, Tex.

[73] Assignee: Halliburton Company, Duncan, Okla.

[21] Appl. No.: 908,756

[22] Filed: Sep. 18, 1986

[51] Int. Cl.[4] ..... E21B 49/08

[52] U.S. Cl. ..... 73/155; 166/264

[58] Field of Search ..... 73/155, 151, 152; 166/100, 264

[56] References Cited

U.S. PATENT DOCUMENTS

| | | | |
|---|---|---|---|
| 3,104,712 | 9/1963 | Whitten | 73/155 |
| 3,780,575 | 12/1973 | Urbanosky | 73/152 |
| 3,811,321 | 5/1974 | Urbanosky | 73/155 |
| 3,952,588 | 4/1976 | Whitten | 73/155 |
| 4,210,018 | 7/1980 | Brieger | 73/155 |
| 4,270,385 | 6/1981 | Hallmark | 73/155 |
| 4,416,152 | 11/1983 | Wilson | 73/155 |
| 4,513,612 | 4/1985 | Shalek | 73/155 |

*Primary Examiner*—Jerry W. Myracle

*Attorney, Agent, or Firm*—William J. Beard

[57] ABSTRACT

A formation tester is set forth. The device utilizes a snorkel extending from the formation tester to obtain a pressure test and collect samples from a formation of interest. The apparatus includes multiple sample storage containers. The sample line is connected to storage containers and also to pretest and post-test drawdown elements which alter the sample line back pressure, thereby cooperating with an equalizing valve to selectively isolate the snorkel from fluid and fluid pressures in the well.

18 Claims, 12 Drawing Sheets

SET PAD, CLOSE EQUALIZER

EXTEND SNORKEL

RETRACT SNORKEL

PRETEST DRAWDOWN

OPEN CHAMBER #1, EXTEND SNORKEL

OPEN CHAMBER #2
EXTEND SNORKEL

CLOSE CHAMBERS
RETRACT SNORKEL

POST TEST DRAWDOWN
40
80
S
S
36
40
R
EV
61
DRILLING MUD ENTERS (H)
51
52
M
P
53
71
60
T
DRILLING MUD AT (H)
55
RV1
GI
54
75
63
64
RV
57
65
A
R
PSD
G2
72
56
58
PSD
B
85
59
76
PV
66
67
60
C
73
CHV1
CHV2
#1 SAMPLE CHAMBER
#2 SAMPLE CHAMBER
G3
D
90
68
69
78
77
E
50
85
F

OPEN EQUALIZER, RETRACT PAD, RESET DRAWDOWNS, RETRACT SNORKEL

FORMATION TESTING TOOL AND METHOD OF OBTAINING POST-TEST DRAWDOWN AND PRESSURE READINGS

BACKGROUND OF THE DISCLOSURE

This disclosure is directed to a formation testing tool and particularly highlights certain methods of operations thereof. After an oil well has been partly drilled and has passed through formations which are thought to be producing formations, one of the next steps in the completion procedure of the well is to perform various and sundry test on formations penetrated by the oil well. One of the test techniques is to lower a formation testing tool into the oil well. Tests can then be performed for the purpose of making certain measurements (e.g. formation pressure) of interest relating to the formation. An exemplary formation testing tool is described in U.S. Pat. No. 4,375,164 assigned to the assignee of the present disclosure. As described in that particular disclosure, the tool is adapted to be lowered into the well borehole, supported on the armored logging cable which includes several conductors for providing power to the tool and surface control of the logging tool. The logging cable extends to the surface where it passes over a sheave and is stored by spooling onto a reel or drum. The conductors in the armored logging cable connect from surface control apparatus and power supplies. They also connect to a surface recording system.

One procedure known heretofore is to lower the formation testing tool a specified depth in the well. At that depth, a backup shoe is extended on one side of the formation tester and formation testing apparatus is extended diametrically opposite the backup shoe. The formation testing equipment includes a snorkel system. Primarily, this involves a surrounding elastomeric sealing pad which isolates an extendable snorkel which penetrates the formation to a specified depth. The snorkel is isolated from fluid and pressure in the well borehole to be able to test the formation only. That is, testing of the formation is conducted while isolating the formation tester from fluids and pressures in the well borehole. When the snorkel is extended into the formation, this enables direct fluid communication from the formation into the tool. This permits taking of a sample, and it isolates the sample from invasion of pressure in the well borehole. This permits a sample to be taken free of contamination of other fluids, and it permits pressure tests to be made by means of a pressure sensor to thereby obtain an accurate readout of formation pressure without distorting the data.

It has been found desirable to run a pretest, a procedure known heretofore. A pretest is implemented after a sealing pad has isolated the formation from the well borehole fluids and the snorkle has penetrated into the formation of interest. In part, the pretest is used to determine whether or not the snorkle has been properly sealed with the surrounding sealing pad, and it is also used to measure the original or beginning pressure at the snorkel in the formation undergoing test. It is possible to obtain formation pressure drawdown and buildup during the pretest sequence which aids in measuring formation permeability. This enables preliminary data to be obtained which is very useful in evaluating the particular formation. Another use is to drawdown sufficient fluid to reduce or overcome formation invasion by drilling fluid.

The present apparatus is directed to a formation tester which has the capacity of obtaining both a pretest and post test sequence, typically formation pressure drawback and buildup sequences. The post test pressure drawdown permits evaluation of formation pressure recovery. Post test data is addition information significant in evaluating the formation.

An important procedure in execution of such test is to have the capacity of extending and retracting the snorkle on command. The snorkel is routinely constructed with a filter screen on the snorkle which may become clogged or plugged at any time in the operation. Retraction and extension after retraction of the snorkel is an important feature to enable the screen area on the snorkel to be wiped clear. When this can be done, this assures additional tests can thereafter be run without distorting the data as a result of clogging the screen on the snorkel.

With the foregoing in view, the present apparatus is described as an improved formation testing apparatus capable of execution of certain improved procedures. One of the enhancement methods of operation is the post test formation pressure drawdown and formation pressure buildup sequence wherein post test formation data can be obtained. Another important procedural advantage of the present invention is the ability to periodically retract and extend the snorkel to thereby wipe the screen on the snorkel clean to prevent clogging. More will be noted concerning these and other features of the disclosed apparatus and method of use hereinafter.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
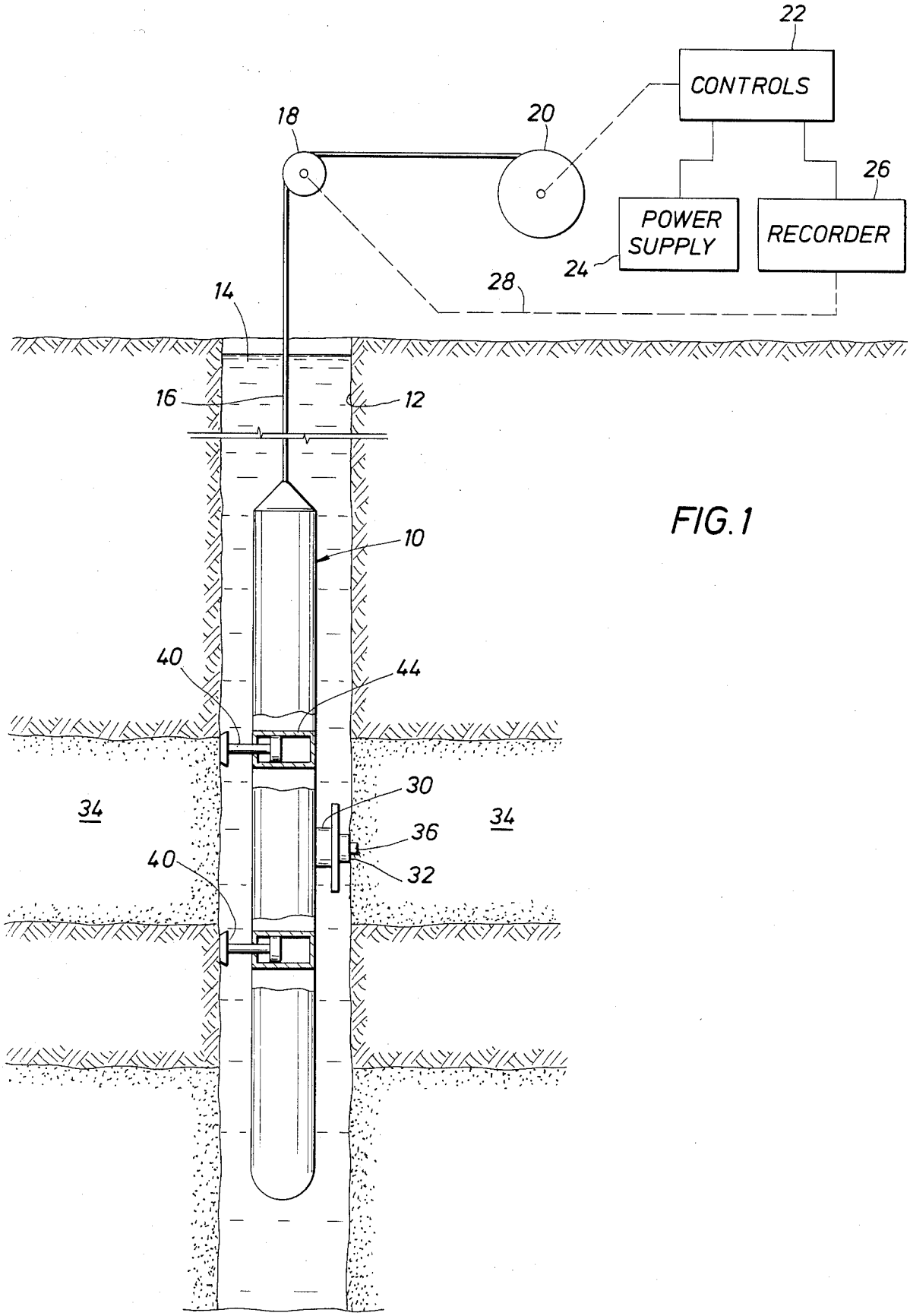
FIG. 1 shows a formation pressure testing tool in accordance with the present disclosure suspended in a well borehole for conducting formation pressure testing.

Attention is directed to FIG. 1 of the drawings where a formation tester 10 is suspended in an open well borehole 12. The well is filled with drilling fluid commonly known as drilling mud indicated at 14. The formation tester is supported on an armored logging cable 16 which extends upwardly to a sheave 18. The cable 16 passes over the sheave and is stored on a drum 20. The armored logging cable 16 encloses several conductors which connect with a control system 22. The control system 22 also connects with a power supply 24 which furnishes power for operation of the formation tester 10 through the cable 16. Data obtained from the formation tester 10 is supplied through the cable 16 to a recorder system 26. The depth of the formation tester 10 in the well borehole is indicated for recording by electrical or mechanical depth measuring apparatus 28 connected to the sheave 18. It is input to the recorder 26 so that the data obtained is matched with the particular depth of the formation tester 10 in the well borehole 12.

Proceeding further in FIG. 1, the formation tester 10 supports a laterally extended probe 30. The probe is driven by a piston to extend from the tool body. It supports a surrounding ring 32 of elastomeric material. The soft material 32 forms a seal pad which seals against the side wall of the well at the formation 34. Assume that the formation tester 10 aligns with the formation 34 suspected to have formation fluids worth producing. The formation 34 is tested by extending a snorkel 36 into the formation. In operation, the snorkel 36 is isolated to enable it to respond only to fluids within the formation 34. This enables a true and accurate measure of formation pressure to be obtained. It is important to obtain such measurements isolated from drilling fluid intrusion. Normally, the drilling fluid forms a mud cake against the side wall of the drilled hole 12. This mud cake is desirable because it helps isolate the various formations penetrated by the well borehole. When the drilling mud packs against the side wall, there is a tendency for fluid in the drilling mud to penetrate into adjacent formations. The solid particles which make up the drilling mud form a filtrate cake against the formation wall. Liquid from the mud cake invades the adjacent formations. It is necessary for the snorkel 36 to then penetrate through the mud cake and sufficiently deep into the formation 34. As will be understood, the snorkel 36 is pushed through the mud cake and deep into the formation. This runs the risk of clogging an entry screen 38 (see FIG. 3). Retraction and extension of the snorkel 36 enables wiping the screen 38 to reduce screen clogging.

Figure 3:
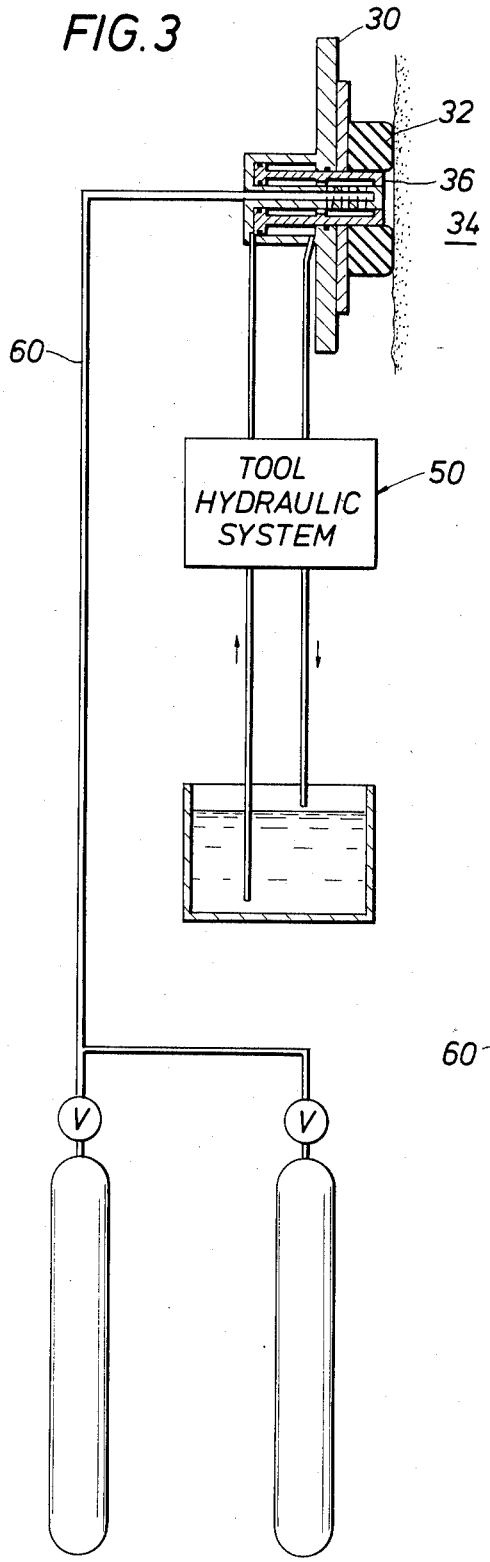
FIG. 3 is a detailed view of the probe of formation tester in the extended position showing the screen thereof which may be blinded by clogging wherein retraction and extension wipe the snorkle screen clean.
Figure 3A:
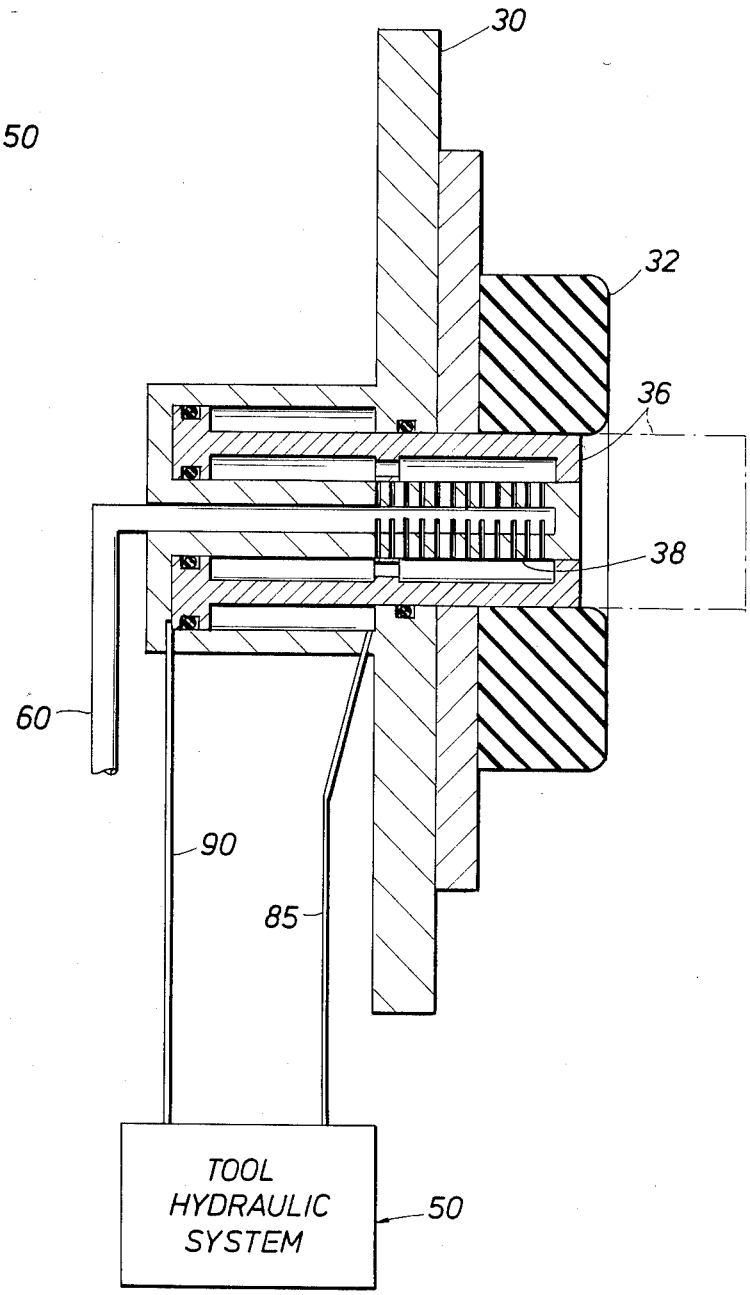
FIG. 3A is a detailed view of snorkel construction.

The probe is ordinarily extended in the manner shown in FIG. 3. To assure alignment and positioning, double acting backup pistons extend backup shoes 40 shown in FIG. 1. Ideally, there two backup shoes. They are vertically aligned along the tool body and are diametrically opposite the seal pad and snorkel. Preferably, one or more is located above the snorkel and a similar arrangement is made below the snorkel. This fixes the tool body at a particular location in the well borehole and assists in securing the tool body during formation testing operation.

Tool operation involves use of the snorkel 36 to fill various pressure vessels within the formation tester 10. The timed relationship of operation of the snorkel to fill the sample chambers in the formation tester 10 will be described in detail hereinafter. Some detail must be given to enhance he understanding of FIG. 3 which includes the hydraulic system generally indicated at 50.

FORMATION TESTER HYDRAULIC SYSTEM

Figure 2:
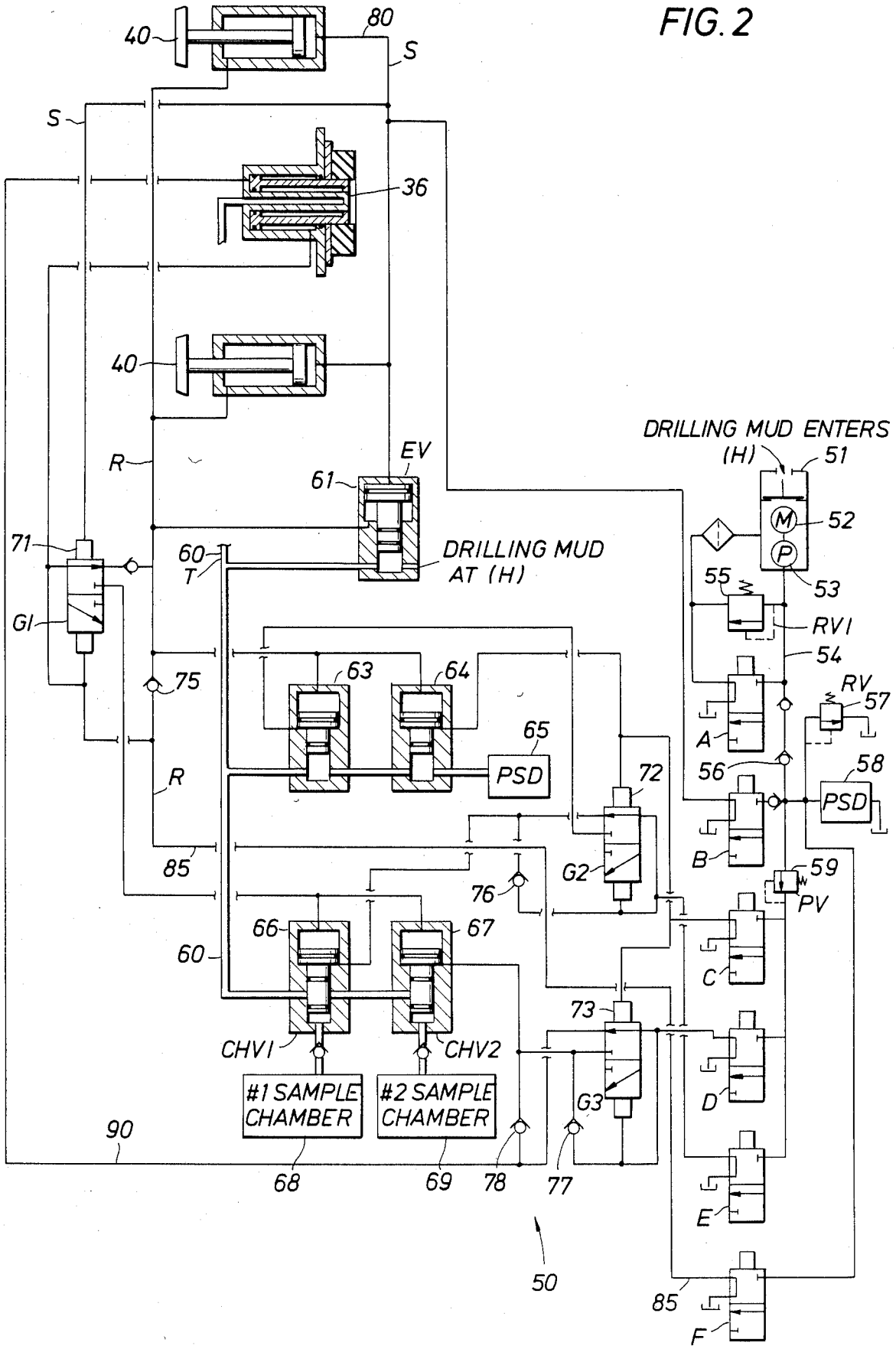
FIG. 2 is hydraulic schematic of the formation tester of the present disclosure showing the circuit thereof.

In FIG. 2 of the drawings, the hydraulic system 50 is shown in detail. The components will be described first and the operation of this system will be set forth in detail later. A chamber 51 establishes a particular hydrostatic pressure level. The chamber is loaded from the exterior pressure above the pressure in the borehole. A motor 52 drives a pump 53 which delivers hydraulic fluid at some pressure greater than the pressure of the drilling fluid. It will be understood that the formation tester 10 is located at different depths in different weights of drilling mud and is therefor eexposed to a highly variable external pressure. The hydraulic system operates at a pressure which is equal to the external or mud pressure plus an increment sufficiently higher to assure operation. It connects with an outlet line 54 which delivers oil at an elevated pressure. A relief valve 55 dumps to sump in the event that pressure is excessive. A check valve 56 in the line 54 prevents back flow. Downstream of the check valve, another relief valve 57 is also incorporated. Additionally, this downstream location is connected with a pressure detector 58 which forms an indication of instantaneous pressure. A serial priority valve 59 is also included to isolate certain control valves in the event the hydraulic system is unable to sufficiently supply all of the control valves at once if there is a momentary high demand for hydraulic oil.

The hydraulic control system 50 incorporates several similar, or even identical control valves. They all have similar construction. They are identified by the letters A–F. Preferably, the valves A–F are all solenoid operated. In the deactivated position they all connect to sump. Connection of each solenoid valve to the sump in the deactivated position has two benefits, (1) to relieve pressure on a component when it is no longer being operated; and (2) to provide a fail-safe method of relieving hydraulic pressure on operated components in the event of power failure. This feature eliminates the need for an emergency dump valve, as used by other systems. When the solenoid is operated, a connected path through the respective control valves is then created.

Going now to additional components in FIG. 2, the backup shoes 40 are also shown spaced on both sides of the snorkel 36. The snorkel is able to receive formation fluid into the snorkel which is received in the formation tester 10 through the sample line 60. The sample line 60 runs from the snorkel 36 to other components as will be described. The sample line includes a branch which connects with the equalizing valve 61, a double acting valve. This valve includes an external port which opens to the exterior to the formation tester 10 to be exposed to drilling mud. The external mud is at a pressure represented by the symbol H, this pressure being introduced by the external port to equalize across the snorkel and seal pad 32 to avoid sticking of the formation tester 10. The equalizing valve 61 selectively opens the external port, to connect the port to the sample line 60.

The sample line 60 also connects with drawdown chambers 63 and 64. The drawdown chambers 63 and 64 have double acting pistons. The sample line 60 also connects to a pressure detector 65. The detector 65 measures the pressure in the sample line.

The sample line 60 additionally connects with first and second storage chamber valves 66 and 67. The two storage valves in turn connect with first and second storage chambers 68 and 69. They are sized to hold samples delivered through the sample line 60 of a specified volume.

In general terms, the apparatus for handling the samples actually obtained has now been described. However, the system 50 includes additional apparatus which should be identified. There are three additional valves identified by the numerals 71, 72 and 73. The system 50 includes check valves 75, 76, 77 and 78. For purposes of easy identification, selected hydraulic fluid lines need to be described. The numeral 80 identifies the setting line. That connects from the control valve B to the equalizing valve 61, the backup pistons 40, and the valve 71. The fluid line 85 is the retract line, and it connects to the equalizing valve 61, backup pistons 40, and control valve F. The numeral 90 identifies the extension line involved in operation of extending the snorkel.

Figure 4:
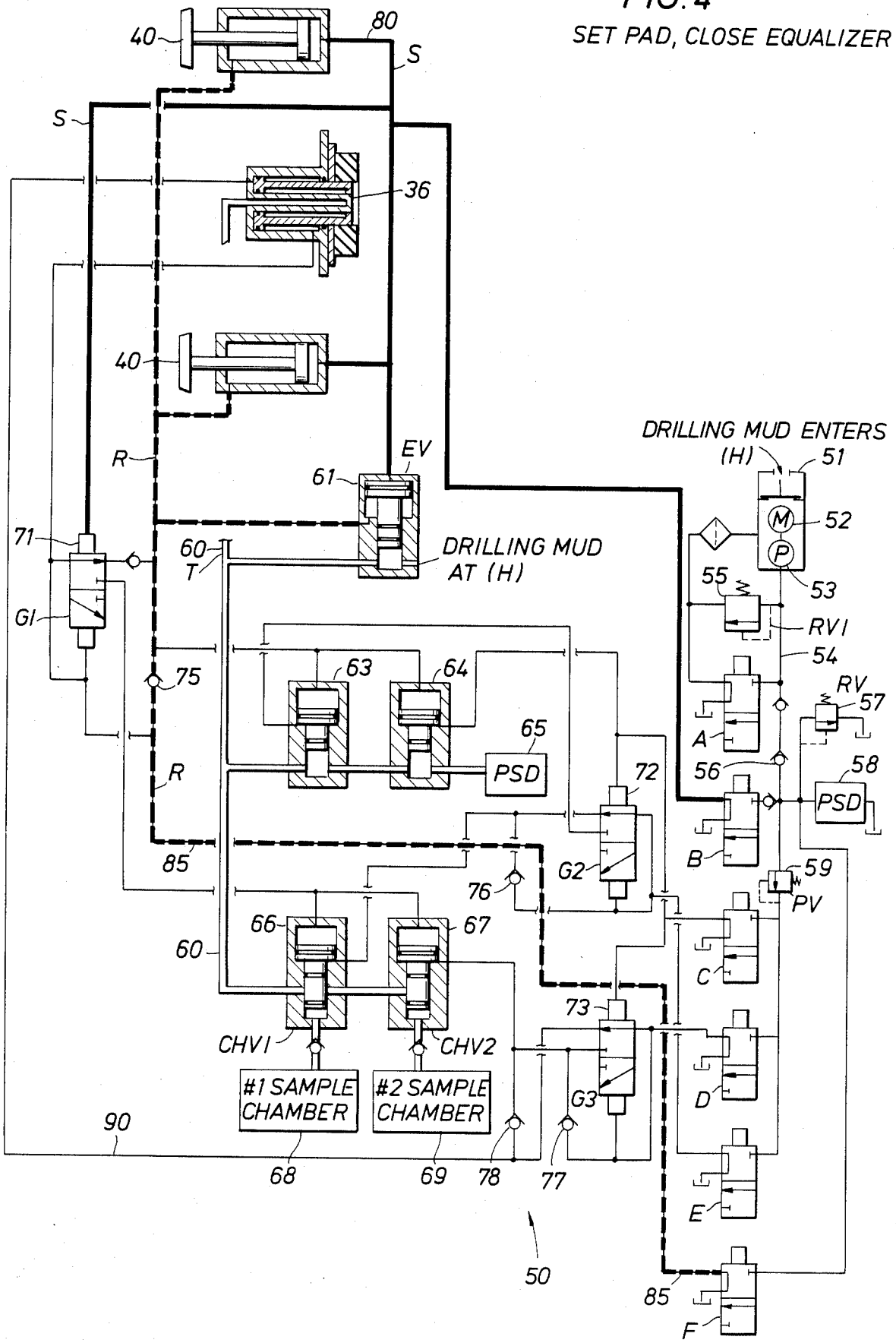
FIGS. 4 through 12 are similar hydraulic schematics showing certain lines pressurized to illustrate certain operational steps.

Operation of the hydraulic system 50 shown in FIG. 2 is enhanced by review of additional drawings. The same structure 50 is shown in all these drawings. However, the supplemental views of the system 50 are highlighted to bring emphasis to the system 50 operation. The views following FIG. 4 can be considered in a sequence, but the sequence maybe varied for a number of reasons. The additional views show fluid flow routes during operation. Accordingly, going now to FIG. 4, hydraulic fluid under pressure is delivered through the setting line 80. This line has been graphically marked in a different fashion to bring this fact out. This sequence is accomplished by switching the control valve B to deliver oil under pressure to close the equalizing valve 61 and to set the backup shoes 40. Also, the pressure on the setting line 80 is delivered to the valve 71 to operate that valve. The setting line 80 powers the double acting pistons 40 to force oil into the retraction line 85. FIG. 4 shows the line 85 highlighted to illustrate this flow path. This oil is returned to sump through the vontrol valve F. When this operation is completed, the equalizing valve 61 has been closed and the pistons 40 have been extended. In FIG. 4, the lines 80 and 85 marked to show the high pressure fluid delivered through the line 80 and fluid returned through the retraction line 85.

Figure 5:
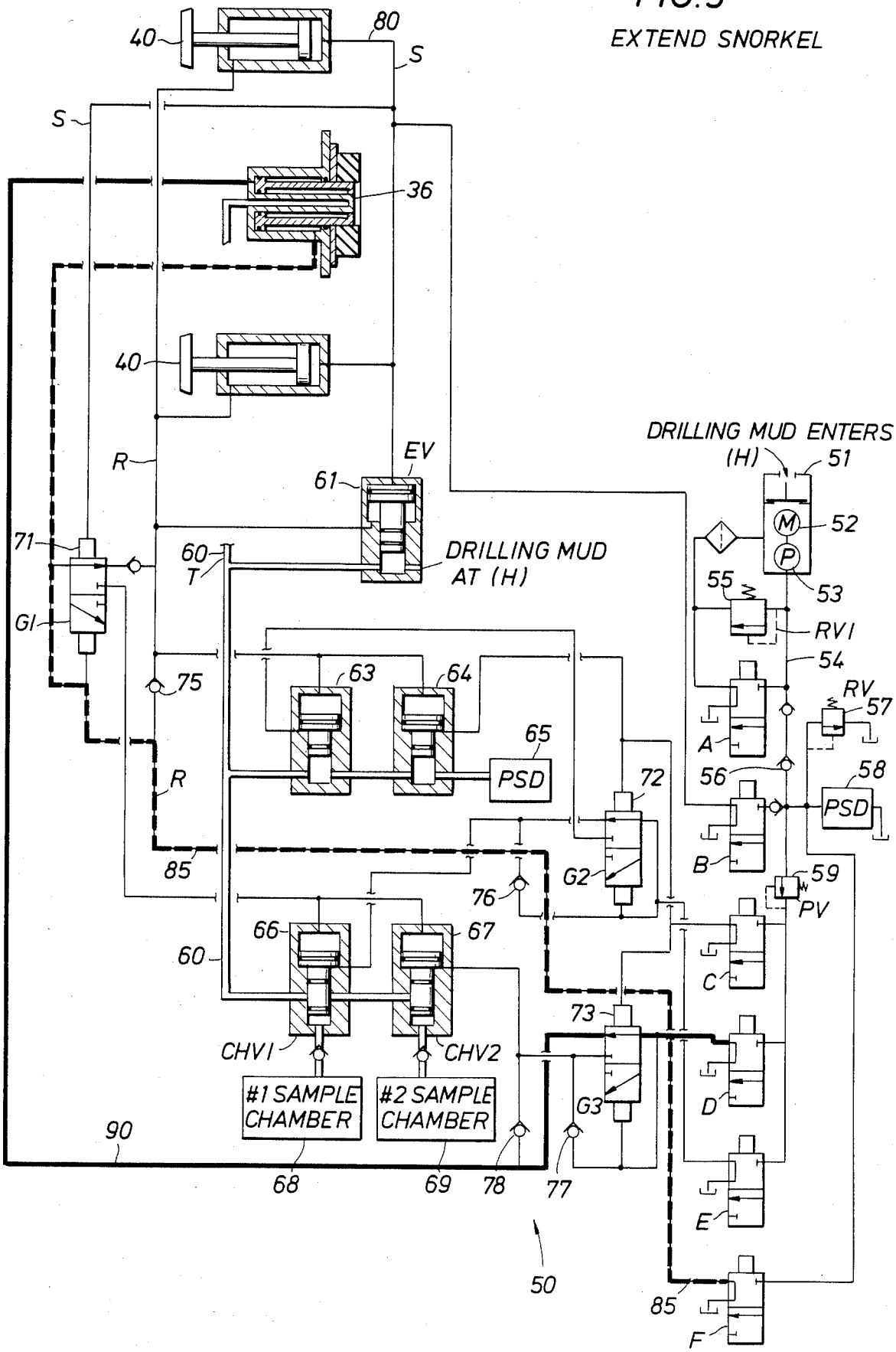

FIG. 4 should be contrasted with FIG. 5 involved with extension of the snorkel. This is accomplished by the control valve D which delivers oil under pressure through the valve 73 into the extension line 90. As the snorkel is extended, hydraulic fluid is returned to the retraction line 85. The two particular flow paths specially marked in FIG. 5 should be contrasted with FIG. 4. To this point, the control valve sequence is first operation of the control valve B and subsequent overlapping operation of the control valve D. The valve operating sequence will be summarized in a chart.

Figure 6:
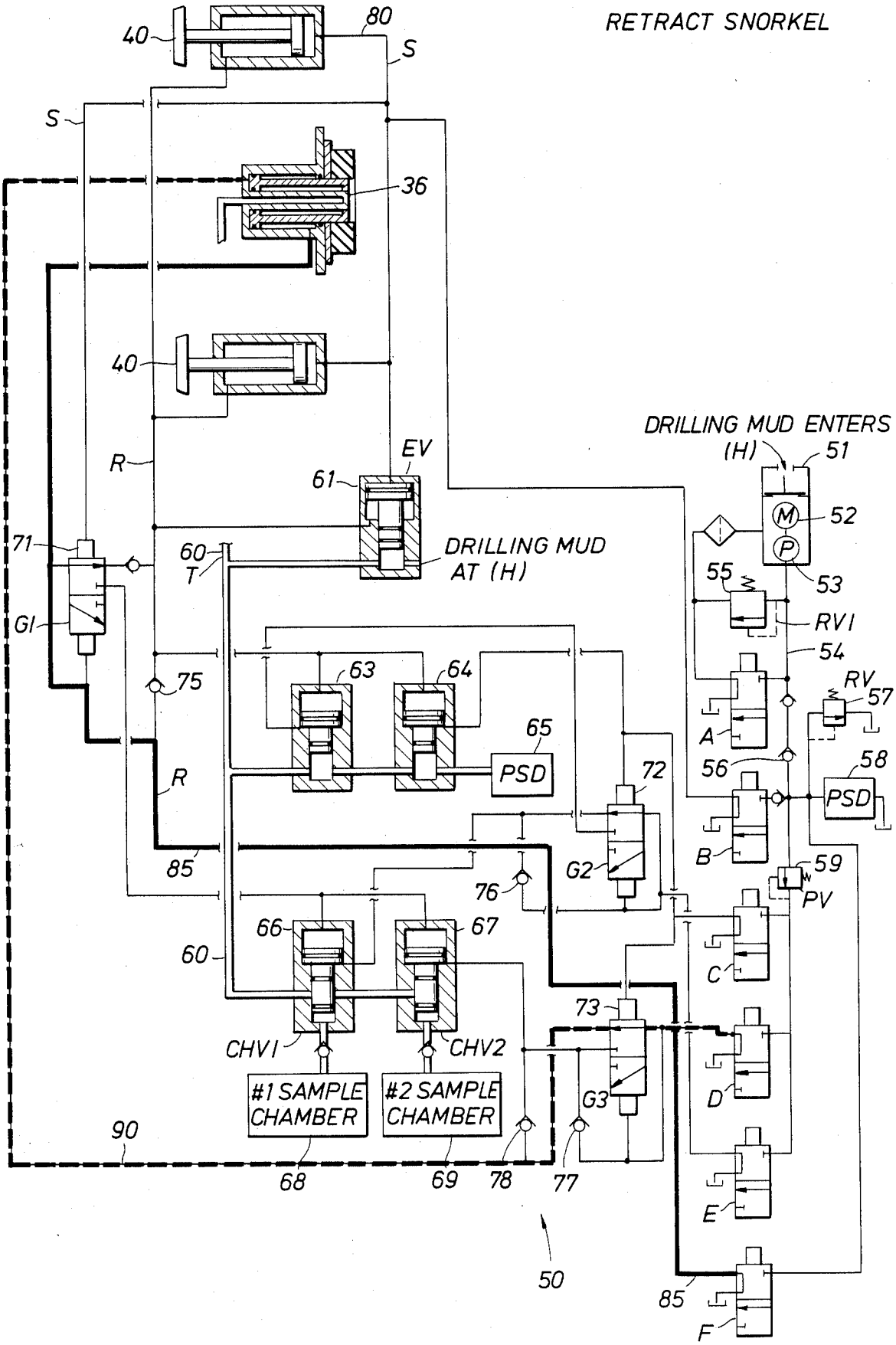

In FIG. 6, the snorkel has been retracted. This is achieved by operation of the control valve F. This delivers fluid under pressure to retract the snorkel. This utilizes the retraction line 85 with part of that line isolated by the check valve 75. Return is through the extension line 90 to the valve 73 (partially blocked by the check valve 77) and return sump through the control valve D.

The operator may by application of suitable control signals extend and retract the snorkel many times to be sure that it is wiped clean. This can be done simply by repeating the sequence of operations shown for FIGS. 5 and 6. Again, both of these steps occur with the valve B sustained open, the equalizing valve 61 closed, the probe 30 extended, and the backup shoes 40 extended. FIG. 6 highlights the involved lines.

Figure 7:
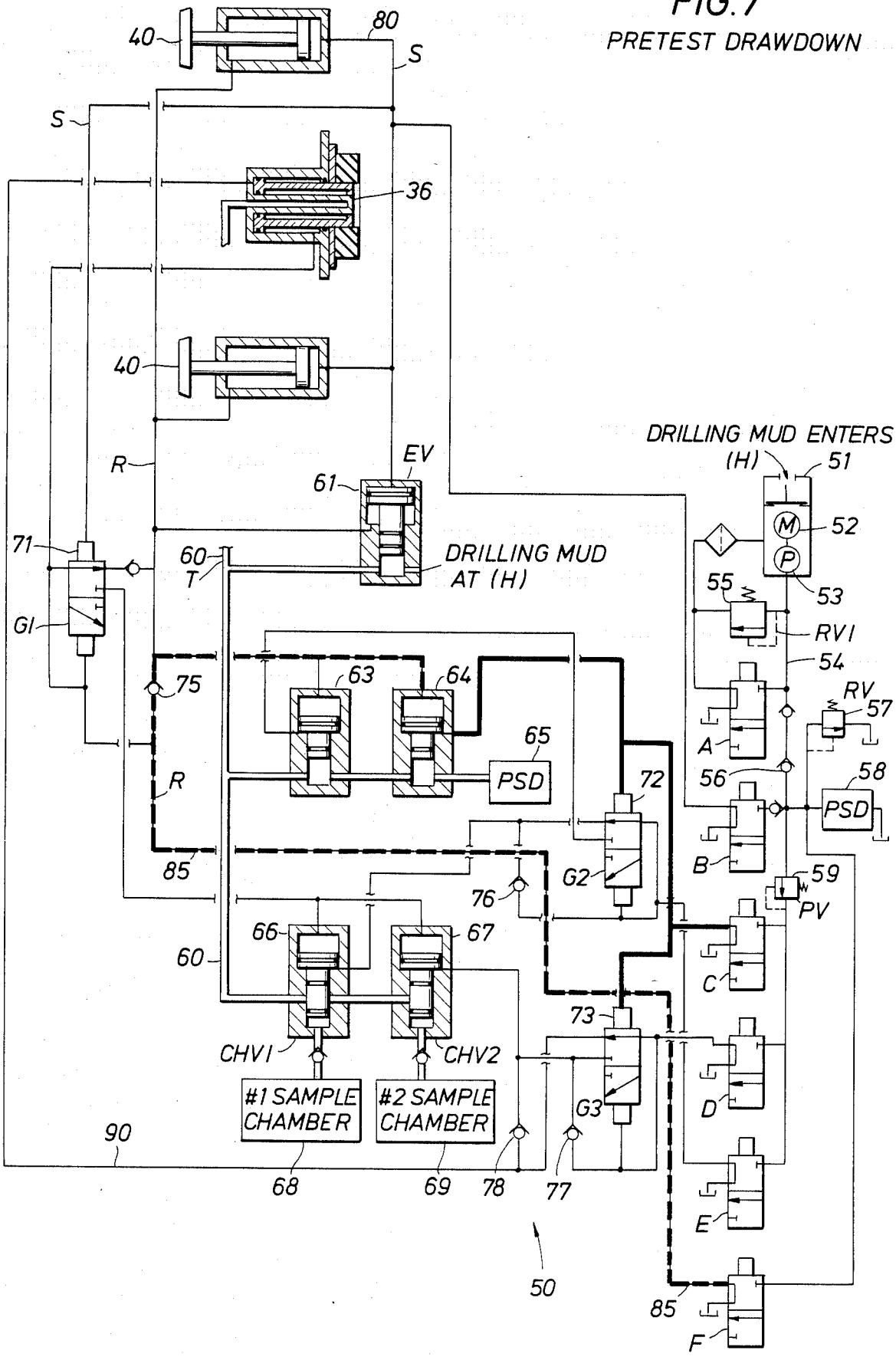

Going now to FIG. 7, the next step is to perform a pretest drawdown from the extended snorkel. In other words, the operation shown with FIG. 7 follows the operation of FIG. 5. Recall that the snorkel may be extended and retracted several times; this pretest sequence is undertaken with the snorkel extended, the position accomplished in FIG. 5.

FIG. 7 shows operation of the control valve C which delivers hydraulic fluid to the drawdown chamber 64 to initiate pretest drawdown. This sequence of operation is best related to the pressures experienced at the snorkel. When the snorkel is first extended into the formation undergoing test, the snorkel is exposed to pressure which is influenced by the drilling fluid in the well. It may also be influenced by the filtrate from the mudcake on the side wall. When the snorkel is extended into the adjacent formation, there maybe a compacting of sand in front of the snorkel which localizes a pressure increase. The snorkel is extended into the formation to observe formation pressure. The initial intrusion of the snorkel and the potential intrusion of mud filtrate are factors tending to provide initial short or long term misleading high reading. To overcome this possibility of an initial high reading, there is a formation pressure pretest drawdown and formation pressure buildup sequence. The pressure detector 65 reads the pressure observed in the sample line 60 from the snorkel. For elimination of the pretest pressure buildup, it is desirable that pressure in the sample line be momentarily reduced. This reduction may draw fluid through the snorkel into the sample line, thereby reducing the pressure disturbances arising from snorkel disturbance of the formation. This is accomplished by pulling a partial vacuum in the means 64. This chamber is filled by the rush of fluid coming through the sample line from the snorkel. After this occurs, fluid from the formation then flows into the snorkel and the pressure in the sample line can then increase. The pressure is observed at the detector 65 and data can be taken representative of formation pressure before testing. The data of pressure versus time implies fluid flow in the formation, or permeability.

Figure 8:
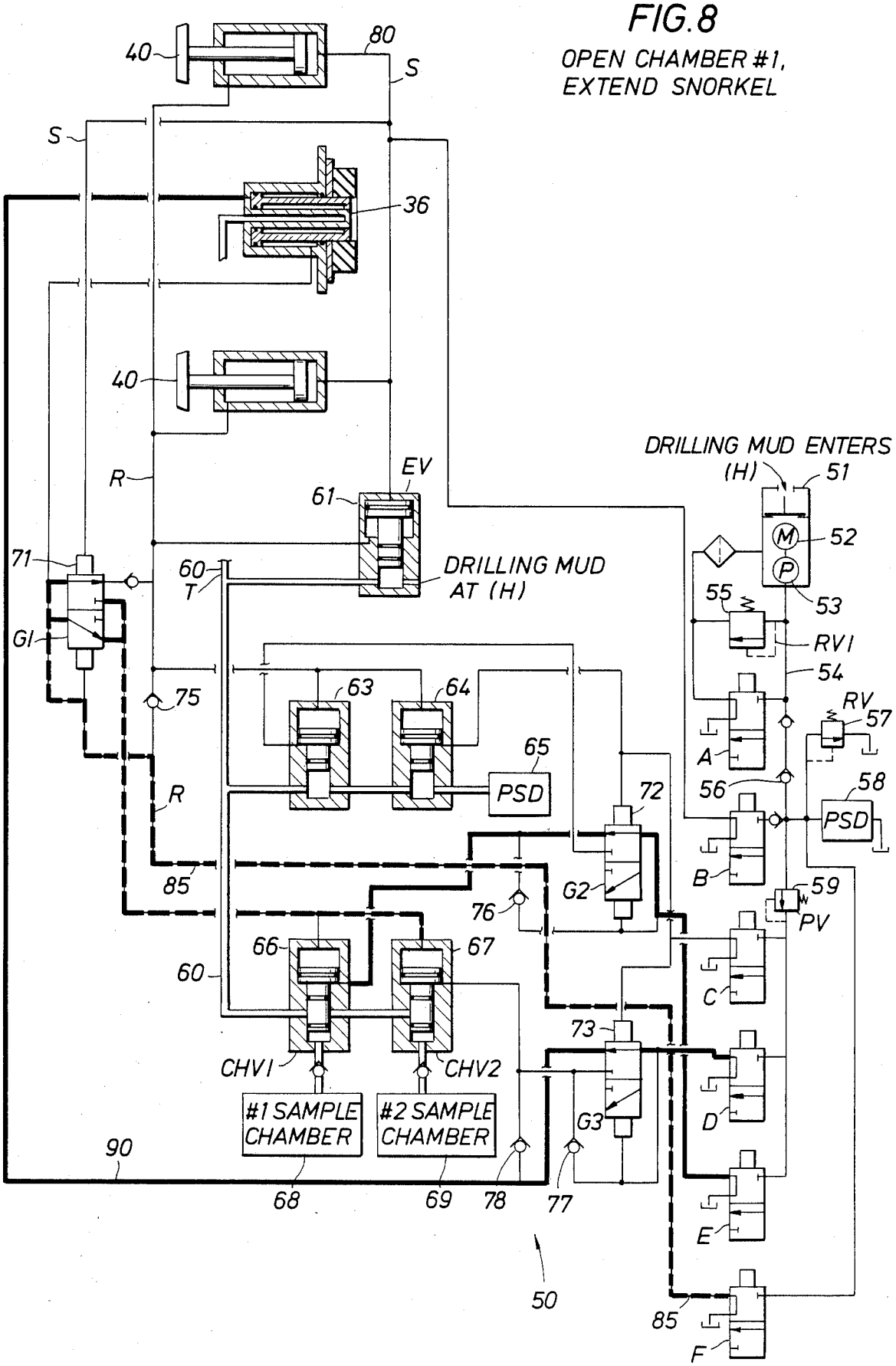
Figure 10:
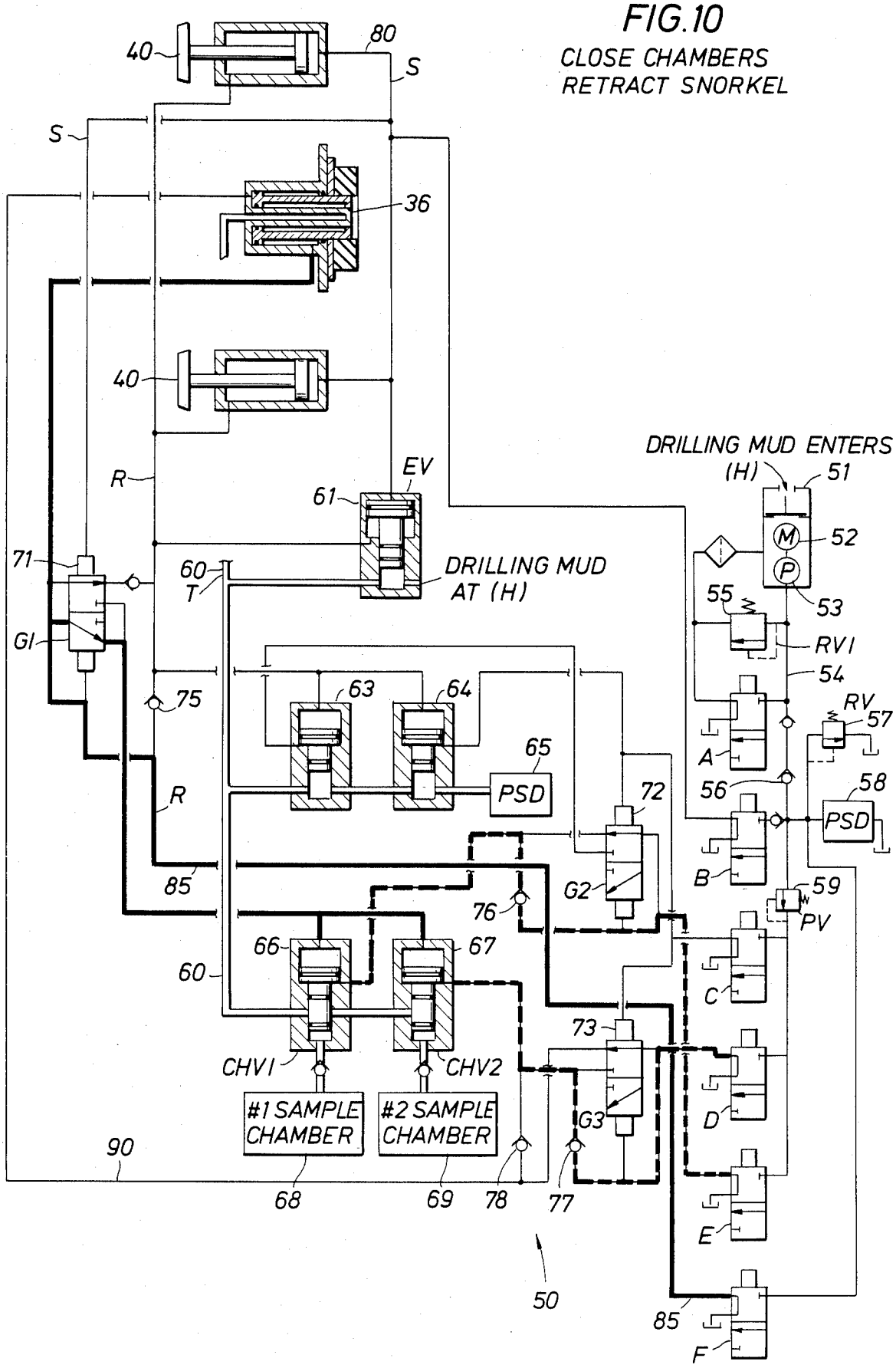

Proceeding in sequence, the next step after a pretest drawdown is to fill the first sample chamber 68. This is accomplished by operation of the control valve E. As shown in FIG. 8, this control valve in conjunction with the valve 72 operates the chamber valve 66. When high pressure is applied to the chamber valve 66, a return route through the valve 71 opens into the retract line 85. That returns fluid to sump by the valve F. After some interval in which the chamber 68 is filled with sample drawn through the snorkel into the sample line 60, it is then necessary to end this sequence by closing the valve 66 to isolate the sample chamber 68. This operation is best understood by reversing that which is shown in FIG. 8. The sample chamber 68 is filled when high pressure is applied through the valve E while the valve F is used to return fluid to sump. The two valves are reversed so that the sequence of operations highlighted in FIG. 8 is then reversed as shown in FIG. 10, high pressure is delivered from the control valve F to close the chamber valve 66 while the control valve E returns to the original position, thereby defining return fluid path to sump. It is to be noted that control valve D is operated while filling the sample chamber 68 to insure that snorkel 36 remains in its extended position.

Figure 9:
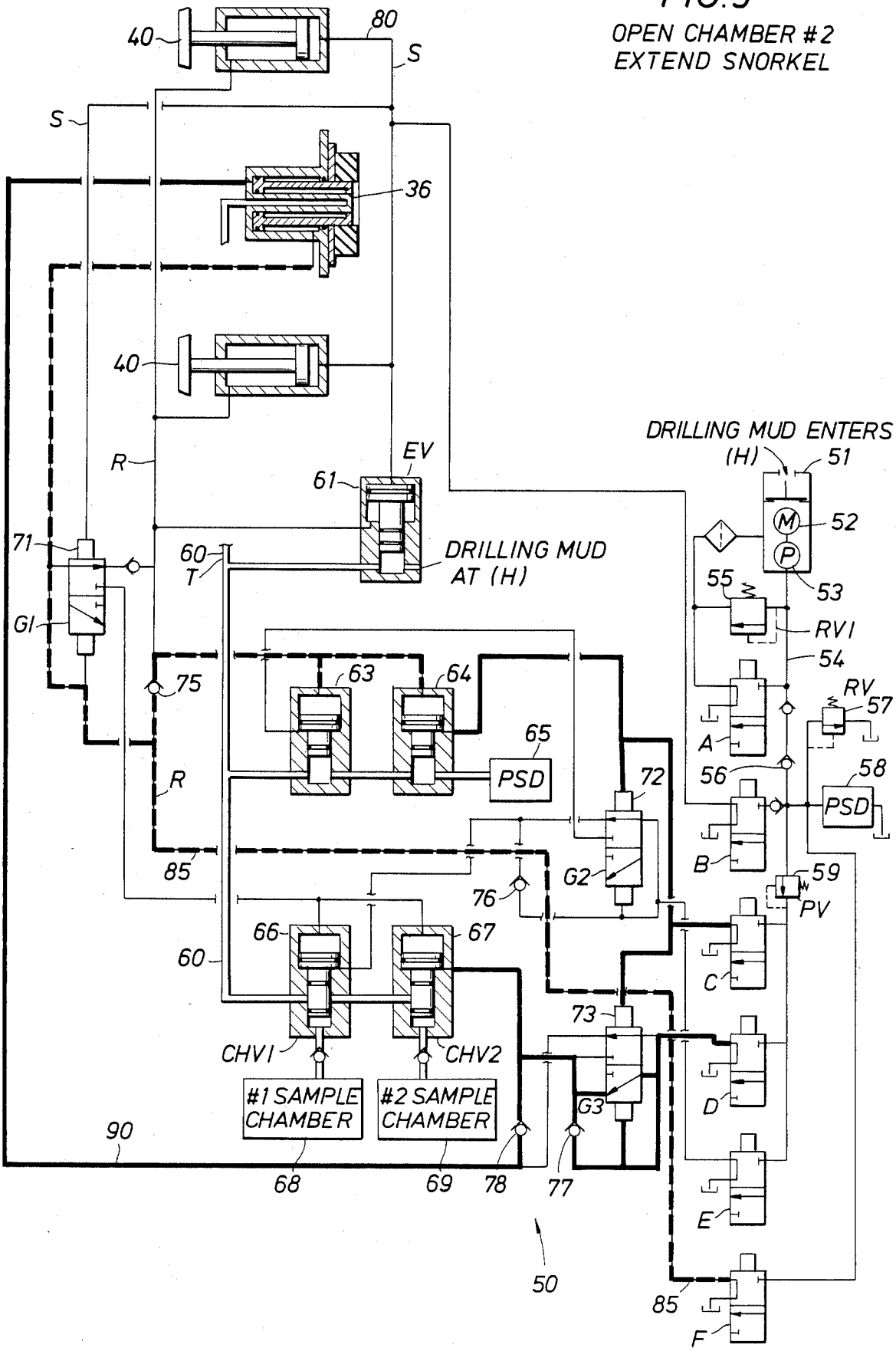

Attention is now directed to FIG. 9 of the drawings. Here, the sequence of operations opens the second sample chamber 69 to receive the second sample. This sequence involves opening both valves C and D simultaneously. The control valve C is operated to apply control pressure to the valve 73. When the control valve C operates, pressure to the means 64 and the valve 72 cause no change. The valve 73 enables high pressure fluid from the control valve D and the valve 73 to operate the chamber valve 67. The chamber valve 67 is operated, thereby enabling the sample chamber 69 to accumulate the second sample. This sample collection is carried on for a period of time until the chamber is sufficiently full. This operation is accompanied by a return of fluid from the chamber valve 67 along the common return path previously discussed with FIG. 8. In this regard, the chamber valves 66 and 67 are connected in common to this return path.

Attention is next directed to FIG. 10 of the drawings which shows joint closure of both of the sample chambers 68 and 69. To accomplish this, the control valve F is operated to apply high pressure fluid from the valve F through the valve 71. This route is through the retraction line 85. The high pressure closes the chamber valve 66 and 67. Return fluid from the chamber valves 66 and 67 flows through two separate routes. The chamber valve 66 return fluid passes through the check valve 76 and then to sump through the control valve E. The chamber valve 67 return fluid is through the check valve 77 and then to the control valve D and to sump.

Figure 11:
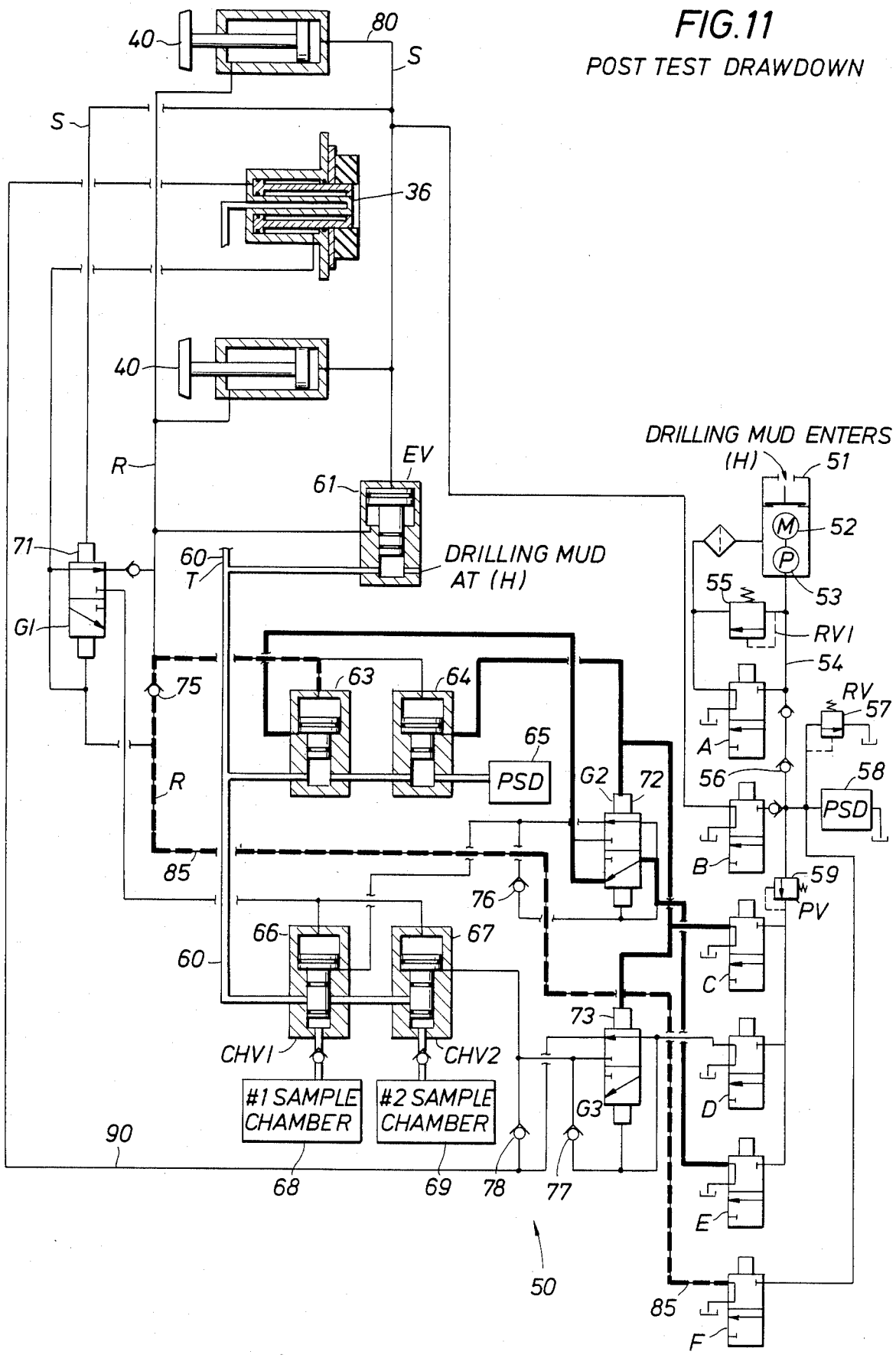

Going now to FIG. 11, the next sequence of operation is shown. Before this step is described, it should be noted that the activities accomplished to this point include the pretest drawdown, filling of the first sample chamber 68 and/or filling of the second sample chamber 69. The sample chambers are isolated by closing off the chamber valves 66 and 67 described in conjunction with FIG. 10. At this time, the pressure in the sample line 60 should settle to formation pressure; if not, pressure in the line 60 will settle a few seconds after closing the chamber valves 66 and 67. A post-test drawdown sequence is then implemented. In this sequence, the means 63 is expanded. This expansion momentarily reduces pressure in the sample line 60. When this occurs, pressure is read at the pressure detector 65. Moreover, this permits additional formation fluid from the snorkel to flow into the sample line. This connects the sample line 60 with the formation to measure formation pressure. In FIG. 11 of the drawings, the post-test drawdown sequence is accomplished by the simultaneous opening of control valves C and E. The control valve C sets the valve 72 for operation, and high pressure fluid from the control valve E flows through the valve 72 and then to the post test drawdown means 63. This is operated for the necessary interval. The pressure information is obtained from the pressure detector 65. In turn, the means 63 delivers return fluid through the outlet line into the retraction line 85, then through the check valve 75 and along the line 85 to the control valve F and then to sump.

Figure 12:
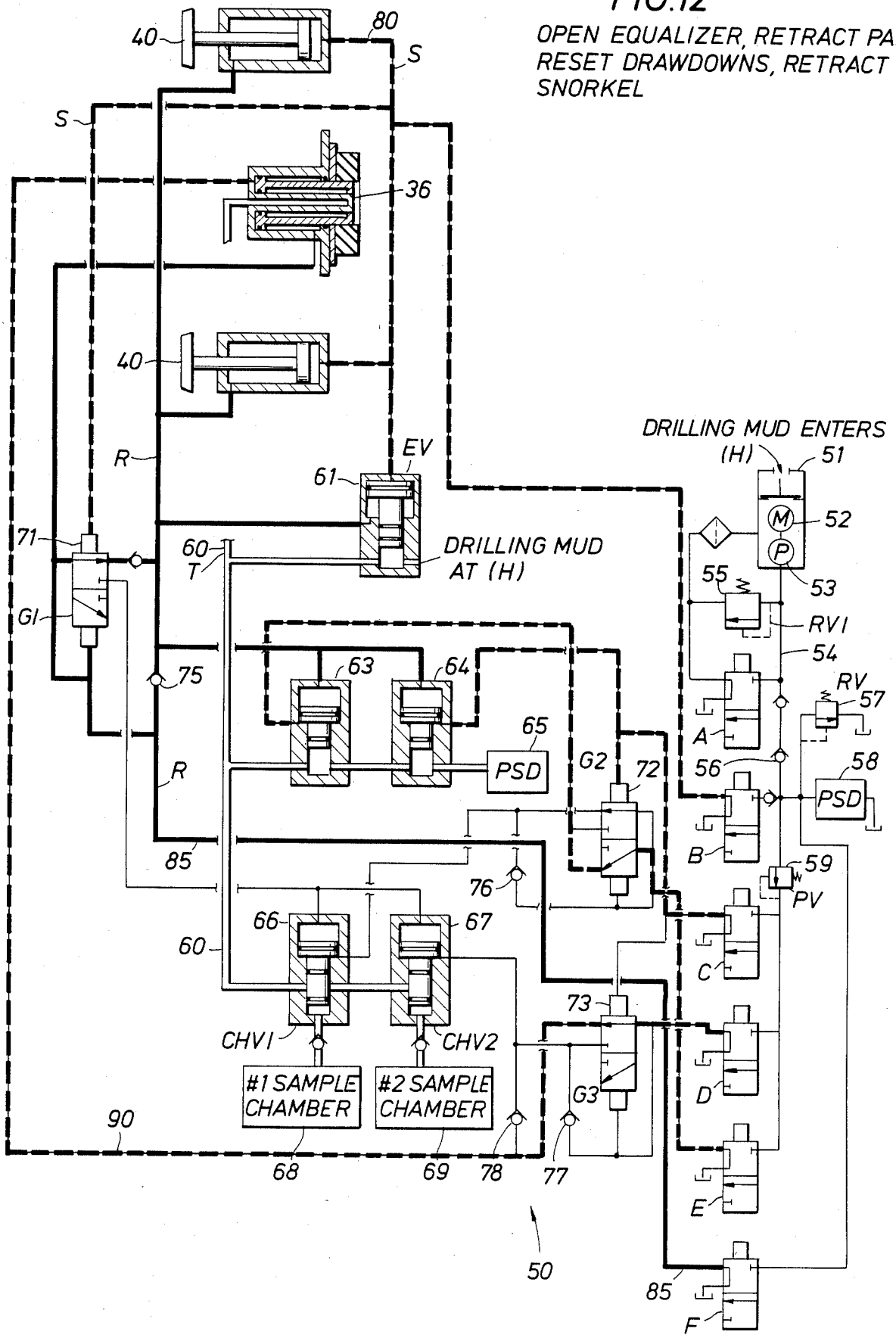

At this point, testing is over and the formation tester can be retrieved. However, after testing is over, the formation tester must be disengaged from the formation 34. This requires that the seal pad 32 and the snorkel be retracted. This is done by reversing the means 63 and 64, that is, reverse the pretest and post-test drawdown. Recall that the means 63 and 64 are chambers which expand, thereby filling with fluid from the sample line. FIG. 12 shows several events which occur in this sequence. It is important to note that the control valve B is closed and thereafter the control valve F is opened. During all the steps (FIG. 4–11) from initial landing of the formation tester 10 opposite the formation 34 to the situation prevailing at the end of FIG. 11 operation, the control valve B was open so that the backup pistons 40 were extended and the equalizing valve 61 was closed. Therefore, FIG. 12 shows the control valve B returned to the initial condition in which it is not operated.

The setting line 80 then becomes a return line for return fluid. This return will be described first. The equalizing valve 61 is opened and a return fluid path is made available for both of the backup pistons 40. Further, the line 80 permits the valve 71 to be reversed, this valve being held under control of the control valve B for the entire sequence of operation beginning with FIG. 4 and extending to FIG. 12. The valve 71 is then reversed. This also opens the sample line 60 to hydrostatic pressure in the well through the equalizing valve 61. This aids in unsticking at the seal pad and snorkel. Assume for purposes of illustration that the pressure in the well is 2000 psi while formation pressure is only 1000 psi. When the equalizing valve 61 is opened, well fluid is permitted to flow through the valve 61 into the sample line 60 and reduces the tendency for pressure differential sticking of the seal pad and snorkel. The seal pad has a greater tendency to stick than does the snorkel. The valve F is thereafter opened. This provides high pessure fluid through the valve F and to the retraction line 85. This retraction line connects with both of the drawdown means 63 and 64. The volumetric capacity of each is reduced, thereby forcing fluid backward through the sample line 60. This tends to increase the fluid delivered through the snorkel, reducing pressure differential sticking potential at the exposed seal pad and snorkel. Moreover, when the pressure from the control valve F is introduced into the line 85, it also is applied to the equalizing valve 61 to provide positive drive for opening. Thus, the double acting equalizing valve is properly powered and a returned fluid path is opened. The pressure in the sample line is thus simultaneously increased while the equalizing valve is opened; these two operations together assure delivery of fluid through the sample line 60 out through the snorkel to accomplish equalization at the snorkel into the formation.

Another facet of operation resulting from the control valve F is application of high pressure fluid to achieve retraction of the snorkel. Additionally, the retraction line 85 accomplishes retraction of the backup pistons 40. The backup pistons have a return flow path through the setting line 80. The snorkel is provided with a return fluid flow path through the extension line 90. This line connects through the valve 73 and then into the control valve D and to sump.

To summarize the sequence of operations, the chart below will assist in understanding the various sequences. The three columns are appropriately labeled as the control valve, operation or the event occurring, and the particular figures (referring to FIG. 4–12) which shows this operation.

| CONTROL VALVE | OPERATION | FIGURE |
|---|---|---|
| Open B | Extend Backup Shoe 40<br>Close Equalizer Valve 61 | FIG. 4 |
| Hold B Open & Open D | Extend Snorkel 36 | FIG. 5 |
| Hold B Open, Close D & Open F | Retract Snorkel 36 | FIG. 6 |
| Hold B Open, Open C | Pretest Drawdown at 63 | FIG. 7 |
| Hold B Open, Close C, Open E, | Fill Sample Chamber 68 | FIG. 8 |

-continued

| CONTROL VALVE | OPERATION | FIGURE |
|---|---|---|
| Open D | | |
| Hold B Open, Close E & Open F | End Sample Filling | FIG. 8 |
| Hold B Open, Open C & Open D | Fill Sample Chamber 69 | FIG. 9 |
| Hold B Open, Close C & Close D & Open F | Close Both Sample Chambers 68–69 | FIG. 10 |
| Hold B Open, Close F & Open C & E | Post-test Drawdown 64 | FIG. 11 |
| Close C & E; Close B & Open F | Open Equalizer 61, Retract Snorkel 36, Retract Backups 40, Reset Drawdowns 63 & 64 | FIG. 12 |

As will be understood, the foregoing procedure is not the only sequence of operation. Through the appropriate operation of control valves A–F, other sequences of operation can be obtained. The control valves A–F are either operated independently, or programmed in the computer for a sequence of operation, or operations.

In use, the present apparatus particularly enables the execution of formation testing with the means 10 to obtain isolated pretest and post-test pressure in the measurements. The drawdown sequence is particularly helpful to remove fluid from the sample line and thereby remove any bias which may arise to obtaining formation pressure measurements. The measurements from the formations are ideally obtained free of bias. The bias, as mentioned before, may arise as a result of filtration from the mudcake of drilling fluids, and may also arise as a result of snorkel intrusion into the formation. It is helpful to have static formation measurements both before and after sample draw. For instance, if after a specified sample is obtained in the sample of chamber(s) in a measured interval, an additional post-sample formation drawdown and pressure buildup observation may be important to observe the duration of rate of formation pressure recovery plus additional formation properties such as an estimate of formation permeability through correlation of pressure/time curves, and deepest possible fluid contacts in part of the formation not penetrated by the borehole. This is indicative of lateral fluid flow (or permeability) in the formation. The second or post-test, formation pressure drawdown and formation pressure buildup versus time gives an additional indication of formation fliud flow, or permeability. This second formation drawdown and formation pressure buildup typically will provide different and more valuable data than formation pretest data since the second or post-test sequence involves more of connate formation fluids and is likely more valuable. An important facet is reduction of differential pressure sticking at the seal pad and snorkel. Recall that the snorkel is extended into the formation and may well be exposed to a significantly reduced pressure. If that is the case, differential sticking is reduced by reversing the flow from the drawdown means 63 and 64. By reversing the flow from the two separate means connected to the sample line, a larger feedback is obtained and thus, the sticking which might occur around the seal pad and snorkel is markedly reduced. As mentioned earlier, the snorkel can be reciprocated several times to wipe the screen of the snorkel clean and reduce the tendency to blind.

There are many other advantages, some perhaps arising from alternate modes of operation of the formation tester 10 of this disclosure. While the foregoing is directed to the preferred embodiment, the scope thereof is determined by the claims which follow.

What is claimed is:

1. A method for performing measurements useful in determining the permeability of earth formations traversing a well borehole, comprising:

(a) establishing, through the wall of the well borehole and isolated from fluids within the well bore, a direct fluid flow path for communication with an adjacent formation to be tested;

(b) drawing a fluid sample from the formation sufficient to substantially remove any well borehole invasion pressure from the immediate area and to enable measurement of connate formation fluid pressure free of borehole invasion;

(c) subsequently making at least one flow test along the fluid flow path from the formation to determine formation flow properties based on the actual connate formation fluids; and (d) making a post test pressure drawdown test after the flow test to measure formation pressure.

2. The method of claim 1 further comprising making a pretest pressure test before the flow test to measure formation pressure.

3. The method of claim 1 wherein the first step includes extending and retracting a snorkel into the formation sufficiently to clear said snorkel of formation material tending to clog said snorkel.

4. The method of claim 3 wherein the step of extending the snorkel is repeated a sufficient number of times to clear the snorkel.

5. The method of claim 1 including the preliminary step of connecting a sample line to a snorkel for obtaining fluids from the formation and also connecting first and second separately operable expandable means to the sample line to enable pressure reduction to be operably and selectively done on the sample line coupled to the snorkel and wherein the snorkel is extended into the formation.

6. The method of claim 1 wherein the step of establishing a direct fluid flow path includes the preliminary steps of:

(a) positioning a formation testing tool in the well borehole opposite the formation;

(b) sealing a pad against the formation;

(c) extending a snorkel through the sealed pad into the formation; and then, (d) drawing the sample through the snorkel by conducting a pretest drawdown into a sample line;

(e) drawing the flow test sample into a sample storage container; and (f) after the flow test, measuring the post test formation pressure through the snorkel.

7. The method of claim 6 including the step of extending the snorkel into the formation from the formation testing tool and isolating the snorkel from well borehole pressure.

8. The method of claim 1 including the step of connecting an equalizing valve between an extendable snorkel and the well borehole, and controllably isolating and connecting through the equalizing valve pressures prevailing in the well borehole to the snorkel.

9. The method of claim 8 wherein the snorkel is connected to a sample storage container, and the equalizing valve is closed to isolate a flow path between the snorkel and the storage container, and is also later opened to define a flow path between the snorkel and pressure prevailing in the well borehole.

10. The method of claim 9 including the step of isolating a flow path between a second storage container and the snorkel.

11. The method of claim 8 including the step of isolating a flow path from the snorkel to a pressure detector to measure formation pessure prior to the step of making a formation flow test.

12. The method of claim 11 including the step of momentarily reducing pessure at the snorkel prior to the step of making the post test pressure test.

13. A formation testing tool for measuring pressure within a formation penetrated by a well borehole, comprising:

(a) an elongate formation testing tool;

(b) a hydraulic power system in said tool including a pump and sump for circulating hydraulic fluid in said system to operate said system;

(c) control valves in said system for controlling operation of said tool; and (d) said control valves having connections in said system, said connections being:

(1) an activated position to apply pressure to at least a part of said system;

(2) a deactivated position to relieve pressure on said system;

(3) a deactivated position connected to said sump;

(e) sample drawing means supported on said tool within the well borehole for establishing, through the wall of the well borehole and isolated from pressures within the well borehole, a snorkel-ended direct fluid flow path communicating with an adjacent formation;

(f) first and second fluid drawing means coupled with said sample drawing means for expanding to reduce pressure from the adjacent formation to substantially remove the well borehole pressure from the immediate area of the snorkel-ended direct fluid flow path to enable connate fluid pressure to act on said sample drawing means; and (g) pressure measuring means cooperative with said control valves to measure formation pressure after operation of said first fluid drawing means prior to drawing formation fluid, and also measuring formation pressure after formation fluid and after operation of said second fluid drawing means.

14. The apparatus of claim 13 wherein said first and second fluid drawing means comprise expandable means connected to a sample flow line connected to said sample drawing means.

15. The apparatus of claim 14 wherein said first and second fluid drawing means further comprises hydraulic controlled chamber means for expanding.

16. The apparatus of claim 15 including a sample collection chamber means, and wherein said valves control filling said collection chamber means after hydraulic operation of said first fluid drawing means and before operation of said second fluid drawing means.

17. The apparatus of claim 16 including a sample line connected from said snorkel-ended direct fluid flow path to said first and second fluid drawing means, and including valve means in said sample line for controlling connection thereof.

18. The apparatus of claim 17 including an equalizing valve connected to deliver well borehole prevailing pressure to said sample line.

* * * * *